US005211112A

United States Patent [19]

Tsushima et al.

[11] Patent Number: 5,211,112

[45] Date of Patent: May 18, 1993

[54] APPARATUS FOR MOUNTING PLATE ON PLATE CYLINDER

[75] Inventors: Kenichi Tsushima; Nobuaki Saito, both of Ibaraki, Japan

[73] Assignee: Komori Corporation, Japan

[21] Appl. No.: 888,184

[22] Filed: May 26, 1992

[30] Foreign Application Priority Data

May 30, 1991 [JP] Japan ..... 3-153839

[51] Int. Cl.[5] ..... B41F 1/28

[52] U.S. Cl. ..... 101/415.1; 101/378; 101/DIG. 36

[58] Field of Search ..... 101/378, 382, 383, 415.1, 101/DIG. 36

[56] References Cited

U.S. PATENT DOCUMENTS

| | | | |
|---|---|---|---|
| 4,727,807 | 3/1988 | Suzuki et al. | 101/415.2 |
| 5,094,165 | 3/1992 | Suziyama et al. | 101/415.2 |
| 5,127,328 | 7/1992 | Wieland | 101/415.1 |

FOREIGN PATENT DOCUMENTS

| | | | |
|---|---|---|---|
| 0144965 | 11/1981 | Japan | 101/415.1 |
| 63-191636 | 8/1988 | Japan . | |
| 1-76231 | 5/1989 | Japan . | |
| 1-127346 | 5/1989 | Japan . | |

*Primary Examiner*—Edgar S. Burr
*Assistant Examiner*—Ren Yan
*Attorney, Agent, or Firm*—Blakely, Sokoloff, Taylor & Zafman

[57] ABSTRACT

An apparatus for mounting a plate on a plate cylinder includes a pair of right and left support levers, a pair of right and left arms, a plate press roller, a plate press pad, and a spring member. The pair of support levers are supported on a support shaft and driven to swing the support shaft. The support shaft is provided close to a circumferential surface of the plate cylinder to extend parallel with the axial direction thereof. The pair of arms are pivotally supported on the support shaft to be close to the pair of support levers. The plate press roller has two ends pivotally supported on the pair of arms and urges the plate against the circumferential surface of the plate cylinder when the plate is to be wound on the plate cylinder. The plate press pad is fixed on a holding member to couple free end portions of the pair of support levers, and has an elastic surface for pressing a trailing-side of the plate. The spring member is interposed between the free end portion of at least one of the support levers and a free end portion of at least one of the pair of arms.

7 Claims, 7 Drawing Sheets

APPARATUS FOR MOUNTING PLATE ON PLATE CYLINDER

BACKGROUND OF THE INVENTION

The present invention relates to an apparatus for mounting a plate on a plate cylinder, in which a plate having one end gripped by a leading-side plate lockup device disposed in a gap in the circumferential surface of the plate cylinder is wound around the plate cylinder, and the other end of the plate is gripped by a trailing-side plate lockup device, thereby mounting the plate on the plate cylinder.

A gap having almost a rectangular section and a length almost equal to the overall length of a plate cylinder is formed in the circumferential surface of the plate cylinder for a sheet printing press. A plate lockup apparatus consisting of a leading-side lockup device for gripping and fixing one end of a plate and a trailing-side lockup device for gripping the other end of the plate, gripped by the leading-side lockup device and then wound around the circumferential surface of the plate cylinder, is fixed on the bottom surface of the gap to extend in the axial direction of the plate cylinder. Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table by being opened or closed as they swing, and a plurality of cams which can be respectively engaged with notches at the edges of the gripper plates. The plurality of cams are aligned along a pivotal cam shaft. A plurality of compression coil springs are interposed between the lockup table and the gripper plates to bias the gripper plates in an open direction.

With the above arrangement, in order to mount a plate on a plate cylinder, when a cam shaft is pivoted, the gripper plates which are divided in the axial direction of the plate cylinder are released upon disengagement from the cams and are simultaneously opened by the elastic forces of the compression coil springs. An end of the plate is inserted between the gripper plates and the corresponding lockup table. When the cam shaft is pivoted in the direction opposite to the direction described above, the gripper plates are pivoted against the elastic forces of the compression coil springs by the behavior of the cams and closed, thereby gripping the end of the plate.

In an apparatus disclosed in Japanese Patent Laid-Open No. 1-127346, a plate lockup table and gripper plates extend in the radial direction of a plate cylinder so that the trailing-side gripper surface of the plate cylinder, which is conventionally formed in the circumferential direction of the plate cylinder, is formed in the radial direction of the plate cylinder. An end of the plate is bent at a right angle by a plate bender which is provided separately. With this arrangement, after a leading end of a plate is gripped and the plate is wound around a circumferential surface of a plate cylinder, the trailing bent portion of the plate is inserted between the plate lockup table and the gripper plates, and the gripper plates are swung by a cam mechanism to grip the bent end of the plate. Thereafter, the overall trailing-side plate lockup device is moved in the circumferential direction, thereby uniformly bringing the plate into tight contact with the circumferential surface of the plate cylinder.

However, in the conventional apparatus for mounting the plate on the plate cylinder, it is difficult to insert the plate in a narrow opening of a leading-side lockup device, leading to a time-consuming operation and much labor. In addition, since the plate which is guided to the trailing-side lockup device while it is wound around the plate cylinder is not brought into tight contact with the circumferential surface of the plate cylinder, it is difficult to insert the trailing end of the plate which is bent almost at the right angle in the opening of the trailing-side plate lockup device, leading to an extra time and an increase in labor. If the plate is not in tight contact with the circumferential surface of the plate cylinder, the plate is deviated during printing to provide unstable printing quality or to degrade the durability of the plate. In order to prevent this, the plate is mounted in the cylinder set state. However, since the printing press must be rotated by one revolution to reach the cylinder set position, the mounting time is prolonged. Also, when the plate is removed in the cylinder set state, an ink remaining on the plate is transferred to the blanket cylinder to soil it.

In order to solve these problems, a plate mounting apparatus as disclosed in Japanese Patent Laid-Open No. 63-19163 is conventionally proposed. FIG. 7 shows this apparatus. This plate mounting apparatus will be described with reference to FIG. 7. A plate cylinder 2 and a blanket cylinder 3 are axially supported between right and left frames 1 of the printing unit to oppose to contact each other. Leading- and trailing-side plate lockup devices 5 and 6 extending in the axial direction of the plate cylinder 2 are disposed in a gap 4 in the circumferential surface of the plate cylinder 2. Plate press cylinders 7 are swingably supported on the frames 1 obliquely below the plate cylinder 2. The operating end of each piston rod 8 of each plate press cylinder **7*b* is pivotally mounted on a lever 10 supported on the corresponding frame 1 by a pin 9. A roller arm 12 is fixed by split clamping on a pin 11 pivotally supported on a free end portion of each lever 10. A plate press roller 13 is pivotally supported between the right and left roller arms 12**.

The operation of the plate mounting apparatus having the arrangement described above will be described with reference additionally to FIGS. 8 and 9. To mount a plate 14, as shown in FIG. 8, gripper plates **5*a* of the leading-side plate lockup device 5 are opened and closed to grip a leading end 14*a* of the plate 14. The piston rods 8 of the plate press cylinders 8 are moved forward to swing the levers 10. Then, the plate press roller 13 is moved close to the leading portion of the plate 14 through the roller arms 12. When the plate cylinder 2 is pivoted in the direction indicated by an arrow A in FIG. 8, the plate 14 is wound around the circumferential surface of the plate cylinder 2 as it is urged against the circumferential surface of the plate cylinder 1 by the plate press roller 13. The plate cylinder 1 continues further rotation until a trailing end 14*b* of the plate 14 which is bent in advance by a plate bender corresponds to the leading portion of the trailing-side plate lockup device 6. When gripper plates 6*a* of the trailing-side plate lockup device 6 are opened and closed while urging the trailing end 14*b* by the plate press rollers 13, the trailing end 14*b* of the plate 14 is gripped by the trailing-side plate lockup device 6. Note that in this prior art, the plate 14** is mounted on the plate cylinder 2 while it is manually held. However, this prior art also discloses a plate mounting apparatus which has a holding unit for holding the plate 14 and causes the leading end of the holding unit to oppose the plate lockup devices 5 and 6, thereby mounting the plate 14 on the plate cylinder 2. This plate mounting apparatus further has an elevating unit, comprising a motor or the like, for vertically moving the overall unit ranging from the plate press cylinders 7 to the plate press roller 13 between an operative position and an retreating position.

In the conventional plate mounting apparatuses described above, however, when each plate press roller 13 is stopped as it opposes the gap 4 in the circumferential surface of the plate cylinder 2, as shown in FIG. 9, since each plate press roller 13 which has been pressing the plate 14 no longer presses it, a portion of the plate 14 near its trailing end floats from the circumferential surface of the plate cylinder 2, as indicated by reference numeral 14*c* in FIG. 9, and thus the plate 14 is not in tight contact with the circumferential surface of the plate cylinder 2 or is not gripped by the trailing-side plate lockup device 6, leading to an unsatisfactory effect. In order to uniformly press the respective portions of the plate 14 by the plate press rollers 13, components, e.g., the plate press cylinders 7, the levers 10, and the roller arms 12, and the elevating units must be provided on the right and left sides of the apparatus, resulting in an increase in cost. In order to synchronously operate these right- and left-side mechanisms, complicated control is needed. If an elevating unit is provided in the apparatus, since the elevating unit occupies a large area, the work space is decreased, and a blanket mounting operation to a blanket cylinder becomes difficult. Furthermore, since the linear movement of the elevating unit must be converted to the pivotal movement of each plate press roller, control to stabilize the plate pressing pressure becomes difficult. Japanese Utility Model Laid-Open No. 1-76231 discloses a plate mounting apparatus in which a plate is mounted while the trailing end of the plate is held by a metal member of a tensile unit to tighten the plate. However, the metal member of the tensile unit may be caught between the plate cylinder and the blanket cylinder, thus impairing safety.

SUMMARY OF THE INVENTION

It is an object of the present invention to provide an apparatus for mounting a plate on a plate cylinder, in which the plate is reliably mounted on the circumferential surface of the plate cylinder and the trailing end of the plate is reliably inserted in a trailing-side plate lockup device.

It is another object of the present invention to provide an apparatus for mounting a plate on a plate cylinder, which does not require any complicated mechanism or control for uniformly pressing the plate.

It is still another object of the present invention to provide an apparatus for mounting a plate on a plate cylinder, in which an elevating unit, e.g., a plate press roller is eliminated to reduce the size of the apparatus.

It is still another object of the present invention to provide an apparatus for mounting a plate on a plate cylinder, which has improved safety and reliability.

In order to achieve the above objects, according to the present invention, there is provided an apparatus for mounting a plate on a plate cylinder, comprising a pair of right and left support levers supported on a support shaft and driven to swing the support shaft, the support shaft being provided close to a circumferential surface of the plate cylinder to extend parallel with the axial direction thereof, a pair of right and left arms pivotally supported on the support shaft to be close to the pair of support levers, a plate press roller, having two ends pivotally supported on the pair of arms, for urging the plate against the circumferential surface of the plate cylinder when the plate is to be wound on the plate cylinder, a plate press pad, fixed on a holding member for coupling free end portions of the pair of support levers, and having an elastic surface for pressing a trailing-side of the plate, and a spring member interposed between the free end portion of at least one of the support levers and a free end portion of at least one of the pair of arms.

BRIEF DESCRIPTION OF THE DRAWINGS

FIG. 1*a* i a view showing the drive means as two air cylinders coupled in series for use in connection with the plate mounting apparatus shown in FIG. 1;

DETAILED DESCRIPTION OF THE PREFERRED EMBODIMENT

Figure 3:
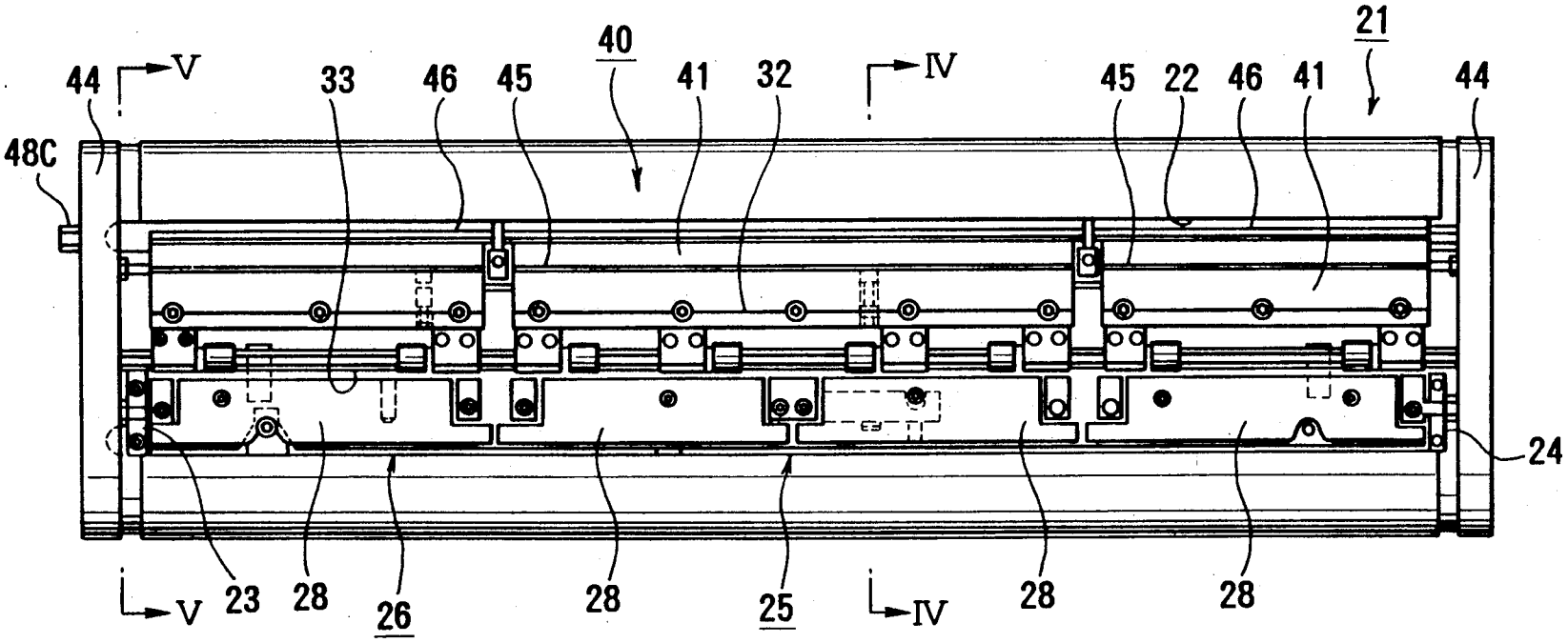
FIG. 3 is a plan view of plate lockup devices of the apparatus shown in FIG. 1.
Figure 4:
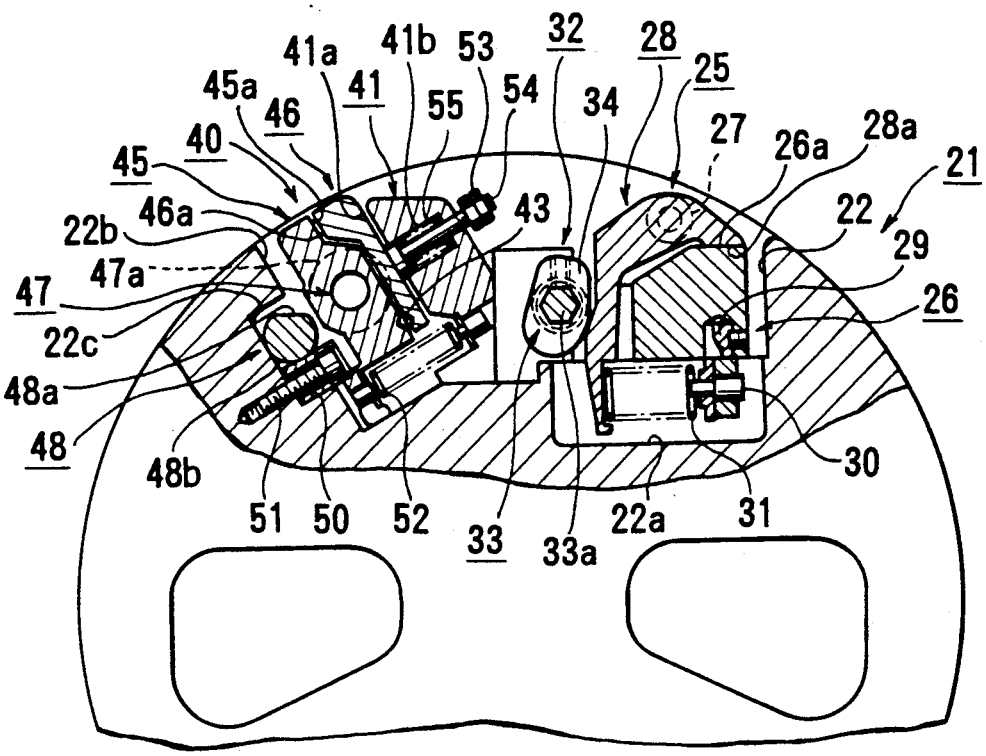
FIG. 4 is a sectional view taken along the line IV—IV of FIG. 3.
Figure 5:
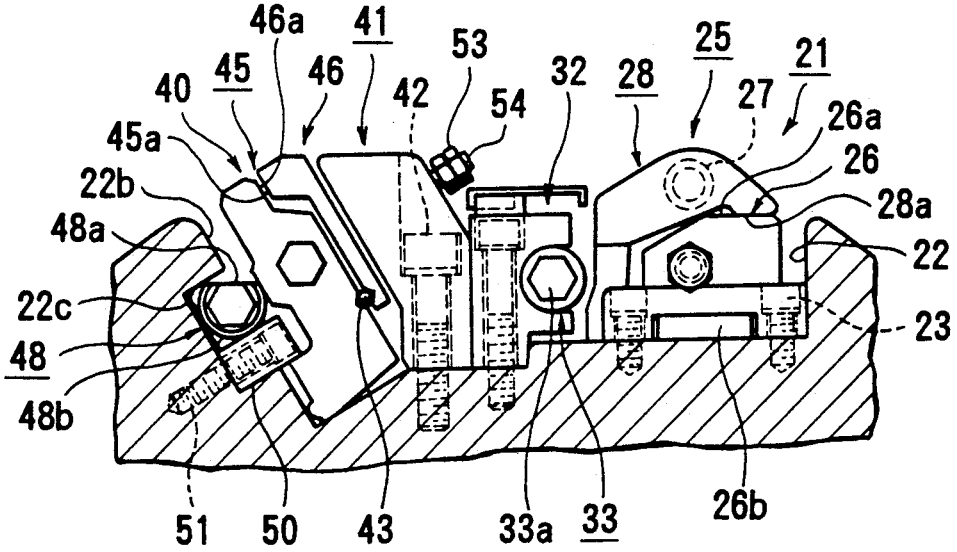
FIG. 5 is a sectional view taken along the line V—V of FIG. 3.

FIGS. 1 to 5 show an apparatus for mounting a plate on a plate cylinder according to an embodiment of the present invention. Referring to FIG. 3, a gap 22 having an almost rectangular section is formed in the circumferential surface of a plate cylinder 21 along almost the overall length of the plate cylinder 21. Saddle-shaped guides 23 and 24 are fixed on the bottom surface of the gap 22 at its two end portions by bolts. A leading-side plate lockup device, a whole portion of which is indicated by reference numeral 25, has a plate lockup table 26 formed to have almost a square section and extending in the axial direction of the plate cylinder 21, as shown in FIG. 4. Vertical movement of thin-walled portions 26*b* at the two ends of the plate lockup table 26 is limited by the left and right guides 23 and 24, as shown in FIG. 5, and the thin-walled portions 26*b* are fitted in the guides 23 and 24 to be slightly movable in the circumferential direction of the plate cylinder 21. The intermediate portion of the plate lockup table 26 is slidably pressed by a plurality of guides (not shown) fixed on the bottom surface of the gap 22 to be prevented from floating.

L-shaped gripper plate holders (not shown) are fixed at a plurality of locations of the plate lockup table 26 by bolts. Four gripper plates 28 divided in the axial direction of the plate cylinder 21 and having an overall length almost equal to that of the plate lockup table 26 are swingably supported on a pin 27 horizontally extending through the gripper plate holders such that gripper surfaces 28*a* of the gripper plates 28 oppose the gripper surface of the plate lockup table 26. Although not shown, a plurality of projections and recessed grooves are formed on the gripper surfaces 28*a* and 26*a* to engage with each other. A plurality of studs 29, a section of each of which is shown in FIG. 4, are aligned on the bottom surface of the plate lockup table 26 in the axial direction of the plate cylinder 21 and project into a recessed hole 22*a* of the gap 22. A compression coil spring 31 for biasing the corresponding gripper plate 28 in a direction to close its gripper surface 28*a* is interposed between a spring reception pin 30 screwed in the screw hole of each stud 29 and a recessed hole in the lower end of the gripper plate 28.

A plurality of rectangular bearings 32 are aligned and fixed at the central portion of the bottom surface of the gap 22 along the axial direction of the plate cylinder 21. A cam shaft 33 having a hexagonal section is pivotally supported on the bearings 32 so that its portions having a circular section are fitted in the bearings 32. A plurality of plate gripper cams 34 each having large- and small-diameter portions are aligned and mounted on the cam shaft 33 in the axial direction. A cam surface of each plate gripper cam 34 opposes to contact the vertical surface of the corresponding gripper plate 28. When a wrench is engaged with the hexagonal cam shaft 33 and turned, the large-diameter portions of the plate gripper cams 34 cause the gripper plates 28 to swing counterclockwise in FIG. 4 against the elastic forces of the compression coil springs 31, thereby opening the gripper surfaces 28*a*.

A trailing-side plate lockup device 40 disposed parallel to the leading-side plate lockup device 25 in the gap 22 has a spring reception bar 41 having an almost equal length to that of the plate cylinder 21 and a vertical section close to the vertical surfaces of the bearings 32. The spring reception bar 41 is fixed on the bottom surface of the gap 22 by a plurality of bolts 42. The spring reception bar 41 has a regulating surface 41*a* extending in the radial direction of the plate cylinder 21. A support shaft 43 extends between the regulating surface 41*a* and a wall surface 22*b* of the gap 22 to be close to disc-shaped bears 44 on two ends of the plate cylinder 21. Three plate lockup tables 45 and three gripper plates 46, each of which are divided in the axial direction of the plate cylinder 21, are swingably coupled to each other through the support shaft 43 on their non-gripper ends such that their gripper surfaces 45*a* and 46*a* extending in the radial direction of the plate cylinder 21 oppose each other. Reference numeral 47 denotes an adjusting screw for coupling the adjacent ones of the three plate lockup tables 45. The right- and left-hand threads of the adjusting screws 47 are screwed in the screw holes of the corresponding plate lockup tables 45. When a tool is inserted in a hole in a collar 47*a* located between the two adjacent plate lockup tables 45 and integrally formed therewith and turned, the gap between the adjacent plate lockup tables 45 is adjusted.

A rod-shaped cam 48 having a flat small-diameter portion 48*a* and an arcuated large-diameter portion 48*b* is disposed in a recess 22*c* formed in the wall surface 22*b* of the gap 22 so as to be pivotally supported on the bears 44. When a wrench is engaged with a hexagonal projection 48*c* of one bear 44 and turned, the cam 48 is pivoted. Reference numeral 50 denotes a guide for guiding the pivotal movement of the cam 48. The guide 50 is fixed in the recess 22*c* in the wall surface 22*b* of the gap 22 by bolts 51. Compression coil springs 52 for biasing the plate lockup tables 45 and the spring reception bar 41 in directions to separate them from each other are interposed in a space defined by a plurality of spring hole bottom surfaces formed on the non-gripper ends of the plate lockup tables 45 and a plurality of spring hole bottom surfaces formed on the spring reception bar 41. Compression coil springs 55 for biasing the gripper plates 46 in a direction to separate them from the spring reception bar 41 are provided between the flanges of spring shafts 54, slidably provided in spring holes 41*b* in the upper portion of the spring reception bar 41 and a moving limit thereof is regulated by a double nut 53, and the bottom surfaces of spring holes 41*b*. Compression coil springs (not shown) for biasing the plate lockup tables 45 in a direction to separate from the gripper plates 46 are provided in spring holes in the upper portions of the plate lockup tables 45.

Figure 1:
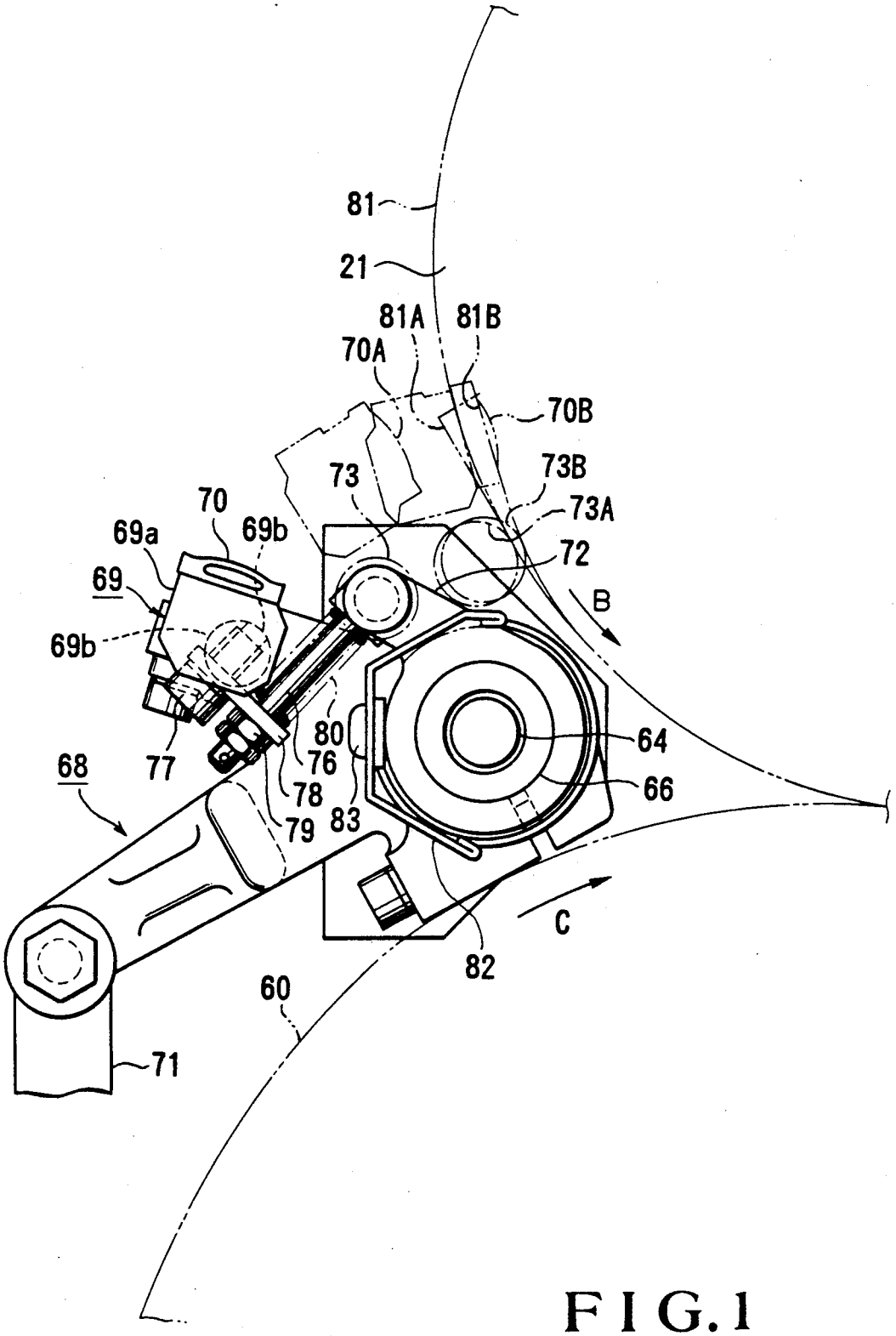
FIG. 1 is a side view of an apparatus for mounting a plate on a plate cylinder according to an embodiment of the present invention.
Figure 2:
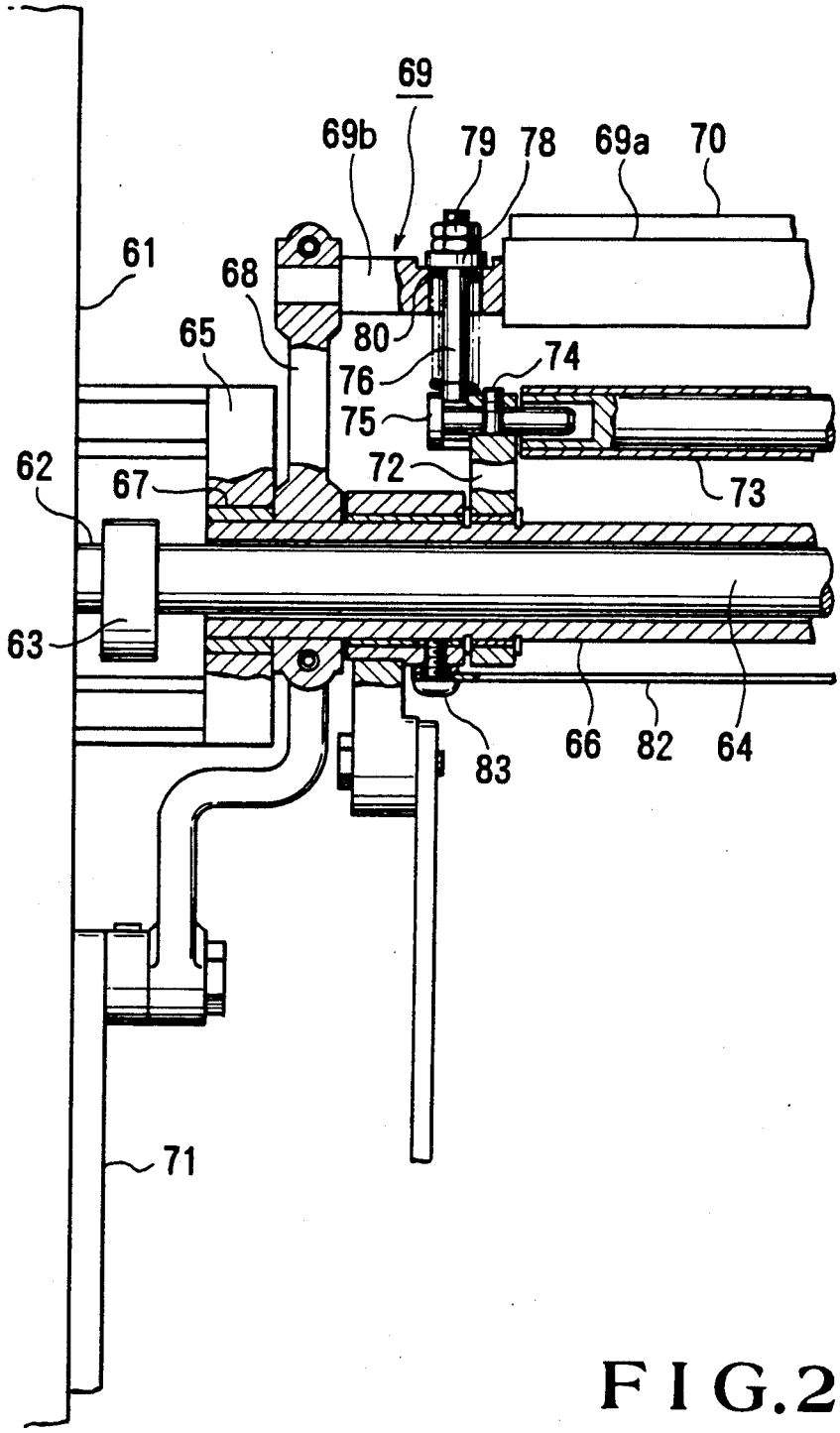
FIG. 2 is a developed front view of the plate mounting apparatus shown in FIG. 1.

Below the plate cylinder 21 having the plate lockup devices as described above, a blanket cylinder 60 opposes to contact the plate cylinder 21 to be detachably mounted on the plate cylinder 21. An existing roller pushup shaft 64, having one end coupled to a drive shaft 62 on the side of one frame 61 through a coupling 63 and the other end pivotally supported on the other frame (not shown), extends in the vicinity of the rotating contact portions of the cylinders 21 and 60 which rotate in directions indicated by arrows B and C, respectively, in FIG. 1 in the cylinder set state. A support shaft 66 fitted in the roller pushup shaft 64 and coaxial with the roller pushup shaft 64 is pivotally supported on brackets 65 extending inwardly from the two frames 61 through bearings 67. An L-shaped support lever 68 is fixed by split clamping on one end of the support shaft 66 adjacent to the bracket 65. A support lever (not shown) having the same shape as the upper half of the support lever 68 is fixed on the other end of the support shaft 66. Each end of a holding shaft 69 serving as a pad holding member is fixed by split clamping on one free end portion of each support lever 68 fixed on the support shaft 66. A pad 70 constituted by an elongated elastic plate, e.g., rubber, is fixed and held on a portion 69*a* having a square section on the holding shaft 69. As shown in FIG. 1*a*, a rod 71 coupled to an air cylinder 61*a* serving as a drive unit is pivotally supported on the other free end of each support lever 68. When the rods 71 are moved forward and backward by the air cylinder, the support levers 68 coupled through the support shaft 66 swing synchronously about the support shaft 66 as the center, and the pad 70 held on the holding shaft 69 moves close to and apart from the circumferential surface of the plate cylinder 21 along an arcuated track.

A pair of right and left arms 72 are swingably supported on the support shaft 66 while their movement in the axial direction is regulated by snap rings. The swingable end portions of the arms 72 are coupled through a pivotal plate press roller 73. That is, a pin 75 is inserted in a hole of the corresponding arm 72. The movement of the pin 75 in the axial direction is regulated by engaging a set screw 74 in an annular hole. A hole in the plate press roller 73 is pivotally fitted with this pin 75, thereby coupling the swingable end portions of the arms 72 through the plate press roller 73. A head formed on one end of a spring shaft 76 is pivotally fitted in a hole of the pin 75. The other end of the spring shaft 76 is inserted in a hole in a spring reception plate 78 fixed on an end shaft 69*b* of the holding shaft 69 by a bolt 77. A double nut 79 is adjustably screwed in the distal screw portion of the spring shaft 76 to be capable of moving forward and backward. A pair of extendible compression coil springs 80 are provided on the spring shaft 76 to be located between the heads of the spring shafts 76 and the spring reception plates 78 on both the right and left sides. When the support shaft 66 is rotated by the air cylinder clockwise in FIG. 1, the plate press roller 73 is urged against a plate 81 on the plate cylinder 21 first. When the support shaft 66 is further rotated, the pad 70 is urged against the plate 81 while compressing the compression coil springs 80. Reference numeral 82 denotes a cover fixed on the support shaft 66 by set screws 83 to cover the support shaft 66.

Figure 6A:
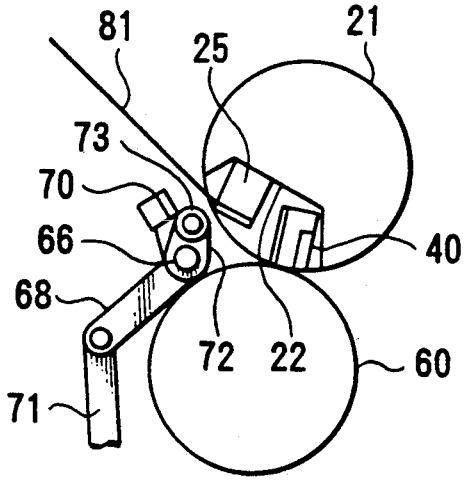
FIGS. 6A, 6B, and 6C are views for explaining the operation of the plate mounting apparatus.

The operation of the apparatus for mounting the plate on the plate cylinder having the arrangement as described above will be described with reference to FIGS. 6A to 6C. When the leading-side plate lockup device 25 of the plate cylinder 21 is caused to oppose the work surface of the operator and stopped and the wrench is engaged with a hemispherical portion 33*a* of the cam shaft 33 and turned, the large-diameter portions of the cams 34 urge against the gripper plates 28 to open the gripper surfaces 28*a*. Hence, the operator inserts one end of the plate 81 in the gripper surfaces 28*a* and rotates the cam shaft 33. Then, the gripper plates 28 are closed by the spring forces of the compression coil springs 31 to grip one end of the plate 80. FIG. 6A shows this state.

Figure 6B:
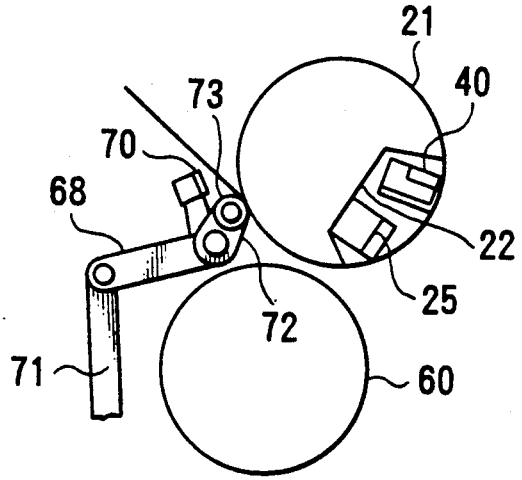

The rods 71 are moved forward by the air cylinder to pivot one support lever 68 clockwise in FIGS. 1 and 6A. Then, the other support lever 68 on the side of other frame integrally formed by one support lever 68 and the support shaft 66 is pivoted synchronously, and the holding shaft 69 having two ends fixed to these support levers 68 and a pad 70 fixed on the holding shaft 69 are moved to close to the circumferential surface of the plate cylinder 21 along an arcuated track about the support shaft 66 as the center. At this time, since the arms 72 are integrally moved with the holding shaft 69 through the spring shafts 76 and the compression coil springs 80 that couple the spring reception plates 78, fixed on the end shafts 69*b* of the holding shafts 69, and the pins 75 on the side of the plate press roller 73, the plate press roller 73 is also moved along an arcuated track in the same manner as the holding shaft 69. In this case, the spring shafts 76 do not slide in the holes in the spring reception plates 78, nor the compression coil springs 80 are compressed or extended. After the support levers 68 are further swung to cause the plate press roller 73 to abut against the plate 81, when the support levers 68 are swung further on, the compression coil springs 80 are compressed and their spring forces act on the plate press roller 73 as the plate pressing forces. In this state, when the swing operation of the support levers 68 is stopped and the plate cylinder 21 is rotated counterclockwise in FIGS. 1 and 6B in the cylinder reset state, the plate 81 is wound around the circumferential surface of the plate cylinder 21 while it is urged against the circumferential surface of the plate cylinder 21 by the plate press roller 73. An alternate long and short dashed line 73A and an alternate long and two short dashed line 70A in FIG. 1 indicate the positions of the plate press roller 73 and the pad 70, respectively, of this state, and FIG. 6B shows a state during winding.

Figure 6C:
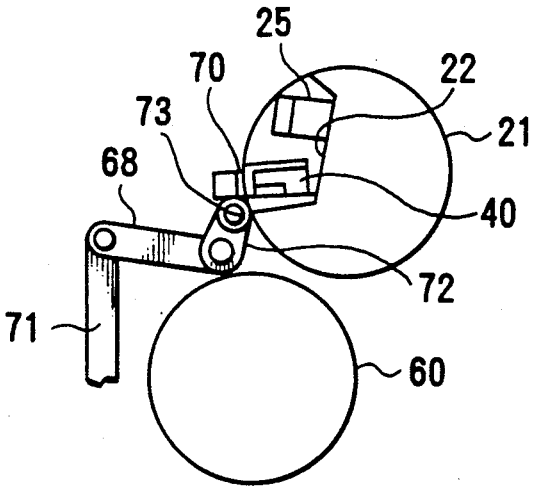
Figure 7:
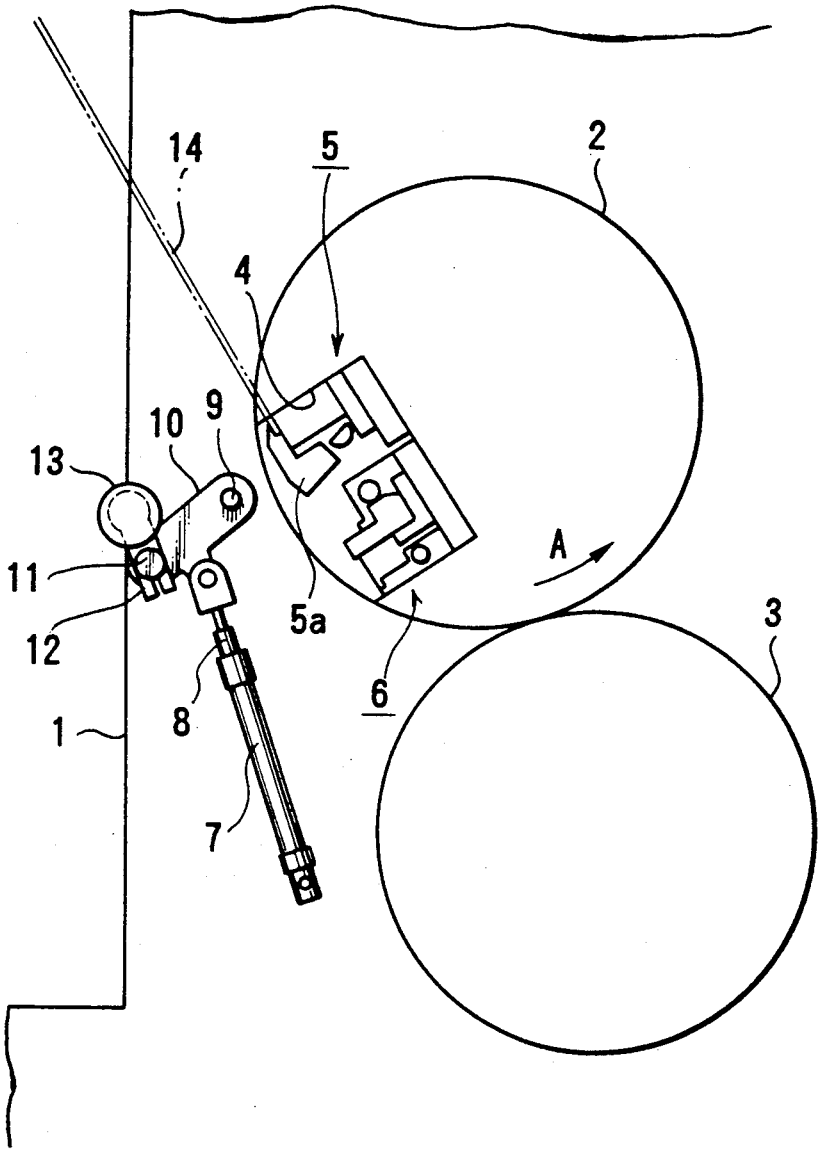
FIG.7 PRIOR ART
FIG. 7 is a schematic side view of a conventional plate mounting apparatus.
Figure 8:
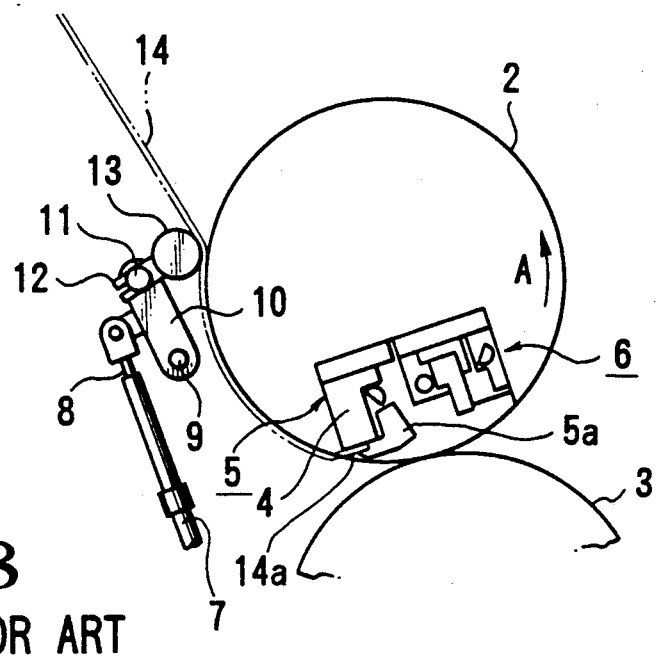
FIG.8 PRIOR ART
FIG. 8 is a view for explaining the operation of the conventional plate mounting apparatus.
Figure 9:
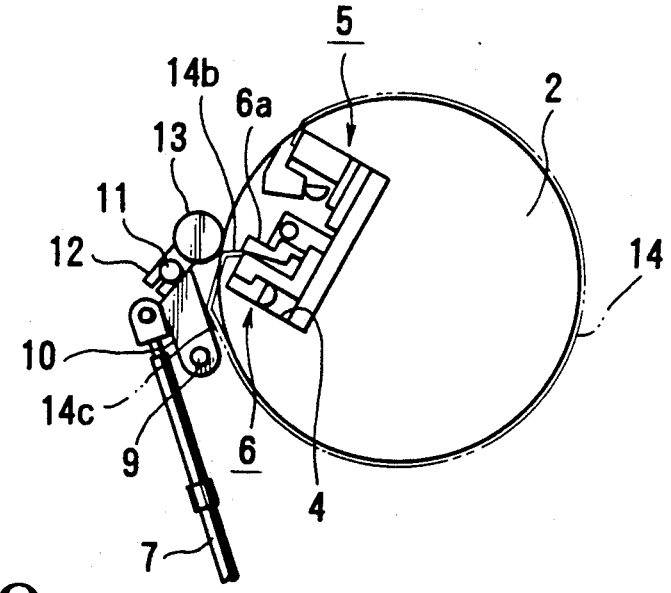
FIG.9 PRIOR ART
FIG. 9 is a view for explaining the operation of the conventional plate mounting apparatus.

When the plate cylinder 21 is further rotated to wind the plate 81 on its circumferential surface and the gripper surfaces 45*a* and 46*a* of the trailing-side plate lockup device 40 oppose the trailing-side bent end of the plate 81, rotation of the plate cylinder 21 is stopped. At this time, the trailing-side bent end of the plate 81 is located between the pad 70*a* and the trailing-side plate lockup device 40, as indicated by an alternate long and short dashed line 81A in FIG. 1. When the cam 48 of the trailing-side plate lockup device 40 is pivoted such that its small-diameter portion 48*a* opposes to contact the plate lockup table 45, the gripper surfaces 45*a* and 46*a* are opened by the elastic forces of the spring members (not shown) provided between the plate lockup table 45 and the gripper plates 46. The rods 71 are further moved forward by the air cylinder to pivot the support levers 68. Although the plate press roller 73A is merely moved to a position 73B in FIG. 1 while it urges the trailing end of the plate 81 into the gap 22, the pad 70A is largely moved to a position 70B while it compresses the compression coil springs 80, to urge the bent end of the plate 81 to a position indicated by an alternate long and short dashed line 81B, thereby inserting it between the open gripper surfaces 45*a* and 46*a*. FIG. 6C shows this state. When the cam 48 of the trailing-side plate lockup device 40 is pivoted to urge the plate lockup table 45 by its large-diameter portion 48*b*, the gripper surfaces 45*a* and 46*a* are closed to grip the plate 81. When the plate press roller 73 and the pad 70 are returned to the initial positions by an operation opposite to that described above, a mounting operation of the plate 81 is completed. Regarding insertion of the trailing end of the plate 81 between the gripper surfaces 45*a* and 46*a*, since the pad 70 urges against the trailing end of the plate 81 while the plate press roller 73 strongly presses the plate 81, the plate 81 will not float from the circumferential surface of the plate cylinder 21, and the trailing end of the plate 81 is reliably inserted between the gripper surfaces 45*a* and 46*a*.

Regarding the air cylinder 71*a* shown in FIG. 1*a* which performs driving in the two step motion by temporarily stopping, during movement, and moving plate press roller 73 and the pad 70, such air cylinder may be implemented as two air cylinders 71*b* and 72*c* coupled in series back to back such that their end sides are bonded with each other, and after one air cylinder is operated and stopped, the other air cylinder may be operated. A two-step motion can be easily obtained without a high-precision positioning sensor. Note that the drive unit is not limited to an air cylinder but can be a motor. In this embodiment, the present invention is applied to an apparatus for manually supplying and removing a plate to and from a plate lockup device. However, the present invention can similarly be applied to an automatic supply/removal apparatus for mechanically holding, supplying, and removing a plate to obtain the similar effect. The structure of the plate lockup device is not limited to that of this embodiment. In this embodiment, the pair of right and left support levers 68 are fixed on the pivotal support shaft 66. However, support levers 68 may be pivotally supported on a stationary support shaft 66. The support levers 68 may have the same shape and be driven by separate air cylinders so that they are pivoted synchronously.

As has been described above, according to the present invention, in an apparatus for mounting a plate on a plate cylinder, a shaft is provided to extend in the vicinity of the circumferential surface of the plate cylinder to be parallel to the plate cylinder, and a pair of right and left levers, driven to swing about this shaft as the center, are fixed on this shaft. A plate press roller is rotatably provided to extend between a pair of right and left arms swingably supported on this shaft to be close to the respective levers. An extendible spring member is interposed between a free end portion of each lever and a free end portion of each arm. Hence, two operations can be performed by one swing operation of the levers. That is, when the levers are caused to swing, the arms coupled to them through the spring members swing so that the plate press roller presses the plate first and then the pad presses the plate. The plate press roller continues to urge against the plate until the pad inserts the trailing end of the plate in the gripper portion without loosening the plate. Therefore, the plate can be reliably brought into tight contact with the circumferential surface of the plate cylinder and the trailing end of the plate can be reliably gripped by the trailing-side plate lockup device, thereby improving the function of the apparatus while providing the apparatus at a low cost. Since the plate can be mounted or removed in the cylinder-removed state as well, the preparation time is shortened to improve the operating efficiency of the machine, and the blanket cylinder will not be soiled or damaged, thus increasing the durability of the apparatus. Furthermore, since a roller elevating unit as in the conventional apparatus is not required, the drive portion, e.g., the cylinder can be effectively disposed on a comparatively empty location, e.g., in the lower cover or under the step. Upon mounting of a plate, since the plate is guided by the plate press roller, it does not contact a safety bar or the like provided to extend close to the circumferential surface of the plate cylinder. Also, since a tensile metal member for holding the trailing end of the plate as in the conventional apparatus is not provided, the metal member of the tensile unit will not be caught between the cylinders, thus increasing the safety. Since the plate need not be held manually during mounting, the labor is decreased.

What is claimed is:

1. An apparatus for mounting a plate on a plate cylinder, comprising:

a support shaft, a pair of right and left support levers supported on said support shaft and driven to swing said support shaft, each of said support levers having a free end portion, said support shaft being provided close to a circumferential surface of said plate cylinder to extend parallel with the axial direction thereof;

a pair of right and left arms pivotally supported on said support shaft to be close to said pair of support levers, each of said arms having a free end portion;

a plate press roller, having two ends pivotally supported on said pair of arms, for urging the plate against said circumferential surface of said plate cylinder when the plate is to be wound on said plate cylinder;

a holding member, a plate press pad, fixed on said holding member for coupling said free ned portions of said pair of support levers, and having an elastic surface for pressing a trailing-side of the plate; and a spring member interposed between said free end portion of at least one of said support levers and said free end portion of at least one of said pair of arms.

2. An apparatus according to claim 1, further comprising a trailing-side plate lockup device with gripper surfaces, wherein said plate includes a trailing-side bent end and said circumferential surface of said plate cylinder includes a gap in which said trailing-side plate lockup device is disposed and said plate press is operated while the plate is urged against said plate cylinder by said plate press roller, and the trailing-side bent end of the plate is inserted between said gripper surfaces of said trailing-side plate lockup device.

3. An apparatus according to claim 1, further comprising drive means for driving said pair of support levers in a two-step motion, and wherein said plate press roller is urged against said plate on said circumferential surface of said plate cylinder by a first-step motion of said pair of support levers, and said plate press pad is brought into tight contact with said plate on said plate cylinder by a second-step motion of said pair of support levers while said press plate roller is in an operative state.

4. An apparatus according to claim 3, wherein, during the first-step motion of said pair of support levers, said spring member transmits a pivotal force to said plate press roller until said plate press roller abuts against said plate on said circumferential surface of said plate cylinder, and causes said roller to generate a plate pressing force after said plate press roller abuts against said plate on said circumferential surface of said plate cylinder.

5. An apparatus according to claim 3, wherein, during the second-step motion of said pair of support levers, said drive means brings said plate press pad into tight contact with said plate on said plate cylinder against an elastic force of said spring member.

6. An apparatus according to claim 3, wherein said drive means comprises two air cylinders coupled in series, so that after one air cylinder is operated, the other air cylinder is operated to perform a two-step motion.

7. An apparatus according to claim 1, wherein there are four said spring members, a respective one of said spring members disposed between each of said free end portions of said pair of support levers and each of said free end portions of said pair of arms.

* * * * *

UNITED STATES PATENT AND TRADEMARK OFFICE

CERTIFICATE OF CORRECTION

PATENT NO. : 5,211,112

DATED : May 18, 1993

INVENTOR(S) : Tsushima et al.

It is certified that error appears in the above-identified patent and that said Letters Patent is hereby corrected as shown below:

In claim 1 in column 10 at line 4 delete "free ned portions" insert --free end portions--.

Signed and Sealed this

Twenty-sixth Day of September, 1995

Bruce Lehman

*Attest:*

BRUCE LEHMAN

*Attesting Officer*

*Commissioner of Patents and Trademarks*